United States Patent [19]

Mikulecky

[11] Patent Number: 4,791,394

[45] Date of Patent: Dec. 13, 1988

[54] SENSOR-TRIPPER APPARATUS FOR A CIRCUIT INTERRUPTER

[75] Inventor: Harvey W. Mikulecky, Oconomowoc, Wis.

[73] Assignee: RTE Corporation, Brookfield, Wis.

[21] Appl. No.: 91,187

[22] Filed: Aug. 31, 1987

[51] Int. Cl.[4] ..... H01H 71/10

[52] U.S. Cl. ..... 335/174; 335/37; 335/170

[58] Field of Search ..... 335/174, 173, 37, 6, 335/170; 361/37

[56] References Cited

U.S. PATENT DOCUMENTS 4,435,690 3/1984 Link et al. ..... 335/37

*Primary Examiner*—H. Broome

*Attorney, Agent, or Firm*—James E. Lowe, Jr.

[57] ABSTRACT

A sensor-tripper apparatus for tripping the trip lever of a circuit interrupter in a power distribution circuit, the apparatus including a trip rod mounted in a tube and supported on a frame, a thermally responsive member having a predetermined curie temperature connected in the primary circuit, a magnet assembly mounted for axial movement on the tube and operatively connected to the trip rod, the magnet assembly being attracted to the thermally responsive member and holding a spring in compression whereby on release of the magnet assembly from the thermally responsive member the spring will move the magnet assembly and trip rod to trip the trip lever and a magnetic disk assembly operatively connected to the trip rod and being responsive to a high fault current in the primary circuit to move the trip rod independently of the magnet assembly to trip the trip lever.

20 Claims, 4 Drawing Sheets

SENSOR-TRIPPER APPARATUS FOR A CIRCUIT INTERRUPTER

BACKGROUND OF THE INVENTION

The present invention relates to under oil fault sensing devices of the type used to trip a vacuum fault interrupter or circuit breaker for interrupting the primary circuit of a distribution system. Curie temperature responsive magnetic devices have been used in transformers to interrupt the primary circuit as described in U.S. Pat. No. 4,435,690 issued on Mar. 6, 1984, entitled "Primary Circuit Breaker." In this patent, a Curie temperature responsive device is described wherein a magnet is mounted on a bell crank for pivotal movement into engagement with a metallic thermal sensing element. The bell crank is biased to move the magnet away from the metal element whenever the temperature of the metal element reaches the Curie temperature allowing the magnet to release from the metal element. The pivotal movement of the bell crank is used to trip the circuit breaker. The magnet will be released from the element in response to both long-time fault currents and short-time overload fault currents. However, under high-fault currents the metallic thermal sensing element is often damaged due to the time required to heat the metal element to the Curie temperature.

SUMMARY OF THE INVENTION

The present invention relates to a sensor tripper apparatus which responds to a rise in temperature in a thermal sensing element due to low fault currents as well as responding instantaneously to high fault currents. Under low fault currents a magnet assembly is released from a thermal sensing element when the Curie temperature of the sensing element is reached. The motion of the magnet assembly on release from the sensing element is used to move a trip rod to trip a primary vacuum interrupter or circuit breaker. Under high-fault currents a magnetic disc assembly responds to the increase in flux density of the primary circuit to instantaneously move the trip rod to open the vacuum interrupter or circuit breaker without moving the magnet assembly.

One of the principal features of the invention is the use of a magnetic disc assembly which responds to high fault currents well before thermal release of the magnet assembly from a sensor strip due to low-fault currents. This results in preventing damage to the thermal sensor, as well as rapid protection of the faulted circuit.

Another feature of the present invention is the use of a magnet assembly having a cluster of magnets which provide a high holding force due to the use of separate flux paths for each of the magnet pole pieces.

Another feature of the invention is the use of a thermal sensing strip having an increased stiffness by the inclusion of stiffening ribs and a center-pierced section in the sensing strip.

Other principal features and advantages of the invention will become apparent to those skilled in the art upon review of the following detailed description, claims and drawings.

Figure 2:
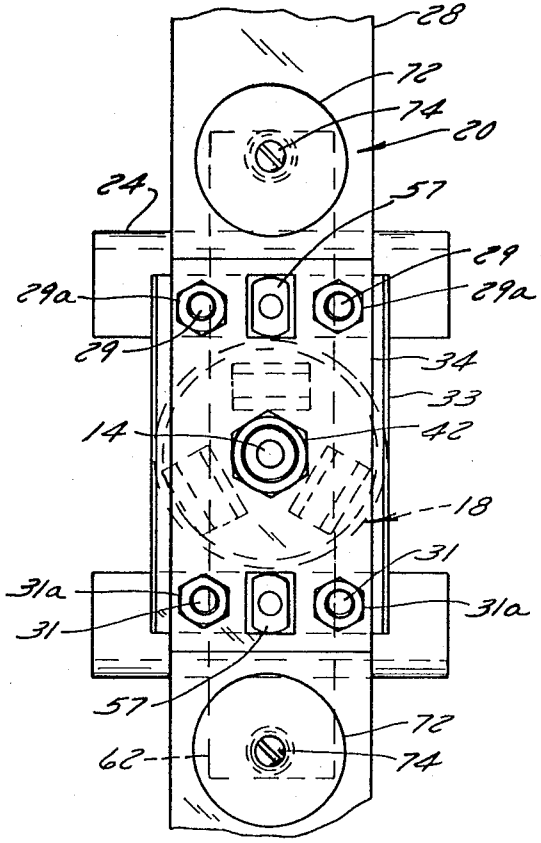
FIG. 2 is a front view of the sensor tripper apparatus shown in FIG. 1.

Before one embodiment of the invention is explained in detail, it is to be understood that the invention is not limited in its application to the details of construction and the arrangments of components set forth in the following description or illustrated in the drawings. The invention is capable of other embodiments or being practiced or being carried out in various ways. Also, it is to be understood that the phraseology and terminology used herein is for the purpose of description and should not be regarded as limiting.

DETAILED DESCRIPTION OF THE INVENTION

Figure 1:
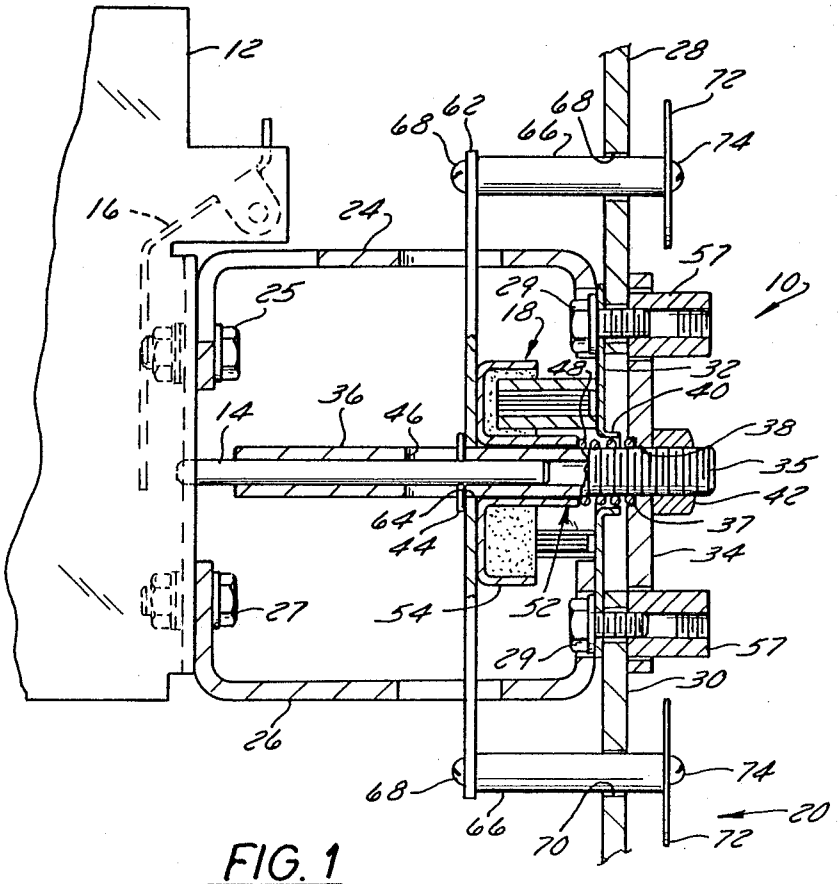
FIG. 1 is a side elevation view in section of the sensor tripper apparatus.
Figure 3:
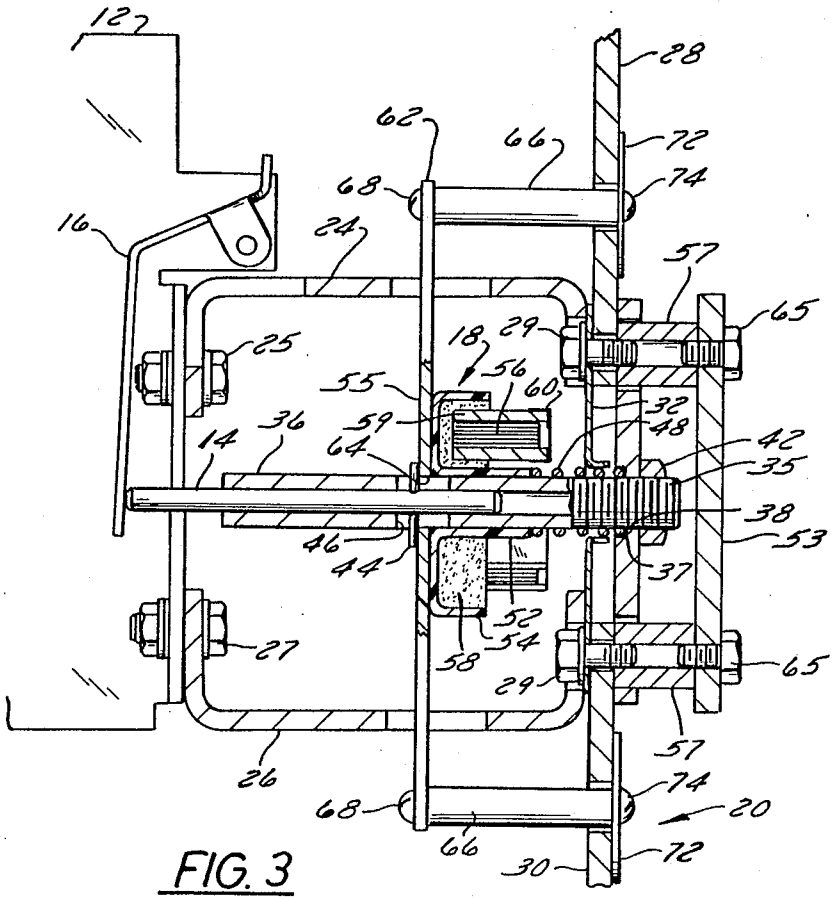
FIG. 3 is a view similar to FIG. 1 showing the sensor tripper apparatus in the trip position.

As seen in FIGS. 1, 2 and 3 of the drawings, the sensor tripper apparatus 10 is shown mounted on a section of a housing 12 for a vacuum interrupter or a circuit breaker connected in the primary circuit of a transformer. The apparatus includes an actuating member or trip rod 14 which is mounted for movement into engagement with a trip lever 16 for actuating a vacuum interrupter or circuit breaker. The actuating member 14 is moved by means of either a low-fault current magnet assembly 18 or a high fault current magnetic disc assembly 20. The low-fault current magnet assembly 18 responds to the Curie temperature of a thermal sensing strip 32 while the high-fault current magnetic disc assembly 20 responds to the current flow in the primary circuit of the transformer.

The apparatus 10 includes a frame or housing formed by an upper U-shaped member 24, a lower U-shaped member 26 and a dielectric backing plate 34 having a central bore 38 and a counter bore 40. An upper bus bar 28 is connected between one end of the upper frame member 24 and the back plate 34 by means of bolts 29 and nuts **29*a*. A lower bus bar 30 is connected between one end of the lower frame member 26 and the backing plate 34 by means of bolts 31 and nuts 31*a*. Means are provided for sensing current flow through the bus bars 28, 30. Such means is in the form of a thermal sensing metallic strip 32 which is connected to the bus bars 28 and 30 by means of bolts 29 and 31. With this arrangement, primary current flows directly through the sensor strip 32**.

The sensor strip 32 includes a center opening 37 and is formed of a nickel-iron alloy commonly known as Alloy 32 as described in U.S. Pat. No. 4,435,690 which contains 32.3% nickel. This material can be set at different Curie temperatures as required by the particular application. Other alloys are available which can be used to provide different Curie temperature responses. Means are provided for stiffening the sensor strip 32. Such means is in the form of a longitudinal rib 33 formed by bending each edge of the strip upward and an annular rib 39 formed by piercing the strip to form the opening 37.

The trip rod or actuating member 14 is supported on the back plate 34 by means of a hollow tubular member 36 having slots 46 intermediate its ends. The tubular member 36 includes a threaded section 35 at one end and extends through the opening 38 in the backing plate 34 and the opening 37 in strip 32. The member 36 is secured thereto by means of a nut 42 mounted on the threaded section 35. The trip rod 14 is mounted for axial movement in the tubular member 36 and is retained in the trip rod by means of a pin 44 mounted in the trip rod 14 and aligned with the slot 46. The extent of movement of the trip rod 14 is limited by the length of the slot 46 provided in the tubular member 36.

Magnetic Cluster Assembly

The low-fault current magnet assembly 18 is mounted on the tubular member 36 for movement into engagement with the sensing strip 32. The magnet assembly 18 will be attracted to the sensor strip 32 by means of the magnetic force formed by a cluster of magnets 56 in the magnet assembly 18. Means are provided for biasing the magnet assembly 18 away from the sensor strip 32. Such means is in the form of a spring 48 which is seated in counterbore 40 and bears on hub 52 on the magnet assembly 18. When the sensing strip 32 approaches the Curie temperature, the magnet assembly 18 will release from the sensor strip 32 and will move the trip rod 14 to the left as seen in FIG. 3 into engagement with trip lever 16 due to the bias of spring 48.

Figure 4:
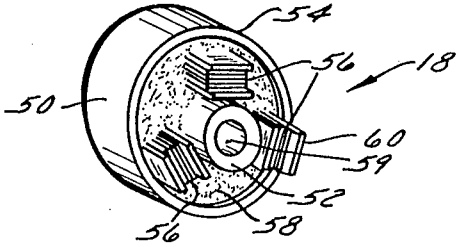
FIG. 4 is a view of the magnet assembly.

In this regard, the magnet assembly 18 as seen in FIG. 4 includes a housing 50 having a cylindrical hub 52 and an outer annular wall 54 connected to the hub 52 by means of a base 55. Three double pole magnets 56 are equally spaced in a circle around the hub of the housing and suported therein by means of an epoxy material 58. Each of the magnets 56 includes two pole pieces 59, 60 which form a separated closed flux path through the sensor strip 32 when the magnet assembly is in contact with the sensor strip 32. Means are provided on the magnets 56 to prevent electrical shorts to the pole pieces 59, 60 from the sensing strip 32. Such means is in the from of a 2 to 3 mil coating of insulation of teflon or polyester provided on the surfaces of the pole pieces.

Means can be provided for changing the thermal response characteristic of the sensor strip 32 in the form of a conductive shunt 53 connected in parallel with the sensor strip 32. The conductive shunt 53 is electrically connected to the sensor strip 32 by means of conductive shunt posts 57 which are secured to the bus bars by bolts 65 and to the shunt 53 by bolts 63.

High-Fault Current Assembly

The high-fault current magnetic disc assembly 20 includes an insulating bar 62 having a center opening 64. The bar 62 is mounted for axial motion on the tube 36 which extends through the hole 64. The bar 62 is positioned between the magnet assembly 18 and the pin 44. An insulating post 66 is mounted on each end of the bar 62 and secured thereto by means of screws 68. The posts 66 project through openings 68 and 70 provided in the bus bars 28 and 30, respectively. A metallic disc 72 is mounted on the end of each of the posts 66 by screws 74. Under high fault current conditions the flux density of the magnetic field around the bus bars will increase rapidly producing a maximum flux coupling or magnetic field with the discs 72. The high fault current disc assembly 20 will respond immediately to the increase in flux density moving the bar 62 against the pin 44 to trip the trip arm 16 without moving the magnetic cluster assembly 18. It should be noted that the magnetic trip discs 72 are located outside of the connections for the sensor strip 32 and the shunt 53 so that the discs 72 will respond to the magnetic field produced by the total current flow in the bus work 28, 30.

Variable Shunt Assembly

Figure 5:
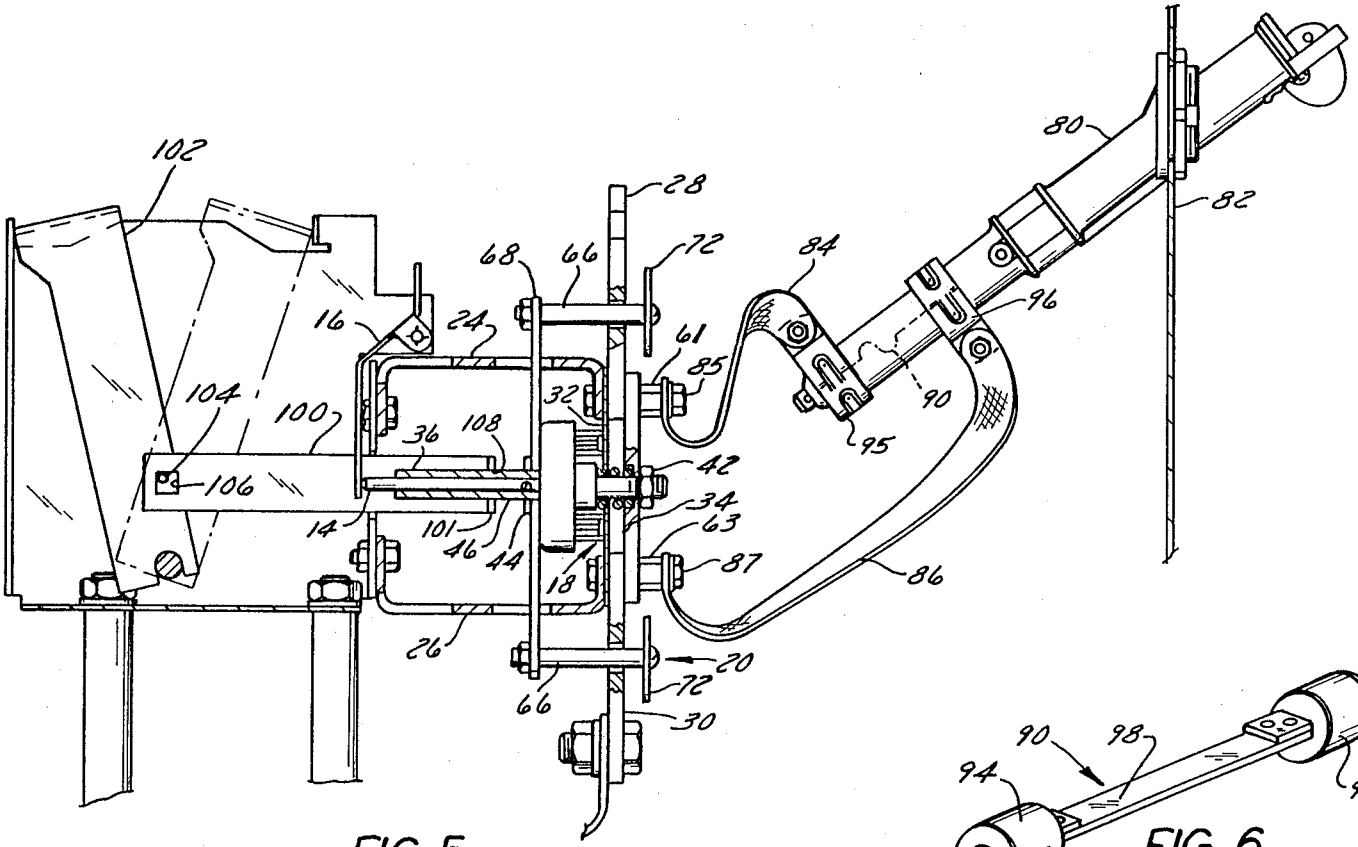
FIG. 5 is a view showing a modified sensor-tripper apparatus shown mounted within a transformer tank and having a variable shunt assembly.
Figure 6:
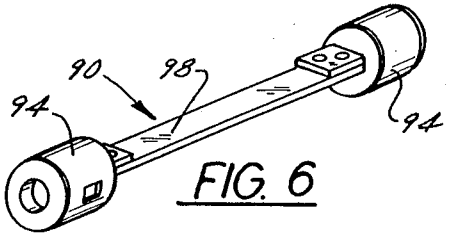
FIG. 6 is a view of the shunt cartridge used in the shunt assembly.

In the modified embodiment of the invention shown in FIGS. 5 and 6, means are provided for selectively changing the time current characteristics (TCC) for the low-fault current magnet assembly 18. Such means is in the form of a replaceable shunt cartridge 90 as shown in FIG. 6. As seen in the drawing, a conventional bayonet-type fuse housing 80 having conductive contacts 95, 96 is mounted on the transformer wall 82. The contact 95 is connected to the conductive shunt post 57 by a strap 84 and a bolt 65 mounted on conductive shunt post 57. The contact 96 is connected to the shunt post 57 by a strap 86 and a bolt 65 mounted on shunt post 57. The shunt cartridge 90, as seen in FIG. 6, is inserted into the fuse housing 80 to provide a current shunt path between the contacts 95, 96 in parallel with sensor strip 32.

The cartridge assembly 90 includes a pair of conductors 94 having a diameter corresponding to the diameter of the contacts 95, 96 provided on the fuse housing 80. A conductive shunt strip 98 is connected to each of the conductors 94. On insertion of the cartridge assembly 90 into housing 80, the shunt strip 98 will be connected in parallel with the sensor strip 32 thus reducing the current flow through the strip 32. The current passing through the sensor strip 32 will vary depending on the thickness of the shunt strip 98 and thereby changing the TCC curves for the magnet assembly 18.

It also should be noted in FIG. 5 that means are provided for resetting the sensor trip assembly. Such means is in the form of an insulated strip 100 which is connected to a reset arm 102 on the vacuum interrupter by means of a pin 104, which extends through an opening 106 provided in the end of the strip 100. The strip 100 includes a flange 101 at the other end with the tube 36 passing through an opening 108 in flange 101. On movement of the reset arm 102 to the right, the strip 100 will move into engagement with the pin 44 pushing both the magnetic disc assembly 20 and the magnet assembly 18 toward the sensor strip 32. The magnet assembly 18 will be attracted to the sensor strip 32 holding the spring 48 in compression between the magnet assembly 18 and the backing plate 34.

Figure 8:
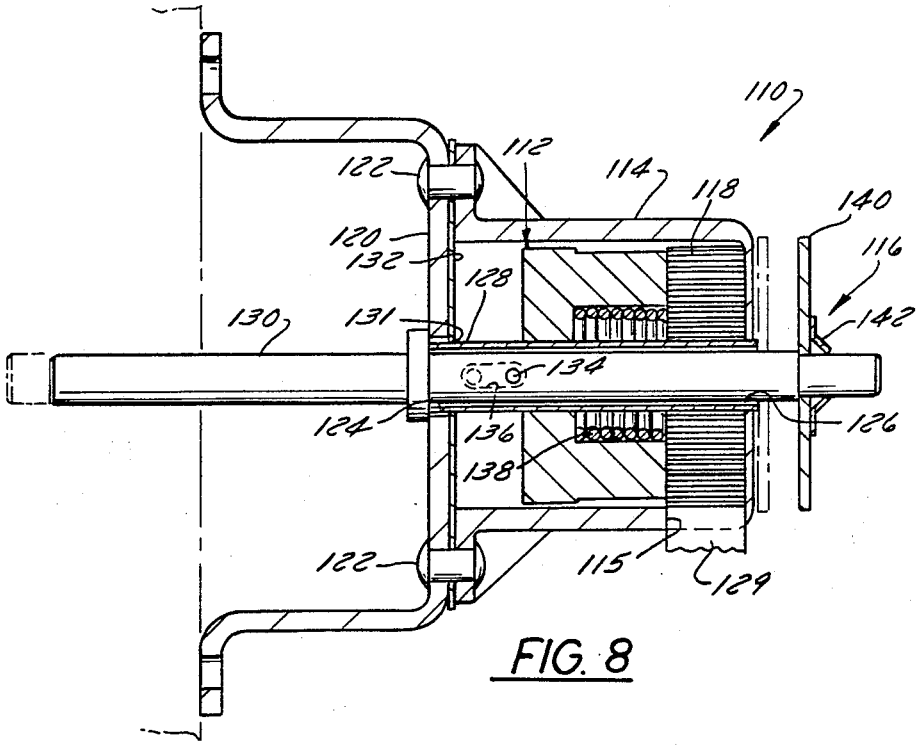
FIG. 8 is a side elevation view in section showing an alternate embodiment of a sensor-tripper apparatus.
Figure 7:
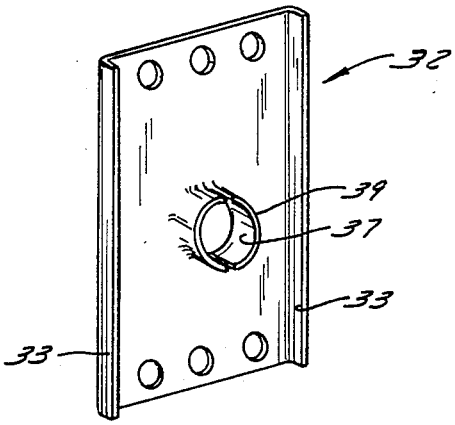
FIG. 7 is a perspective view of the sensing strip showing the longitudinal and annular stiffening ribs.

In the alternate embodiment of the invention shown in FIG. 8, a sensor-tripper assembly 110 is shown which includes a low-fault current magnet assembly 112 mounted within a housing 114 and a high-fault current magnetic disc assembly 116 mounted on the outside of the housing 114. A thermal sensing coil 118 is provided in the housing which is used both for the operation of the magnet assembly 112 and the magnetic disc assembly 116. In this regard it should be noted that the housing 114 is mounted on a main support bracket 120 by rivets 122. An opening 124 is provided in the main support bracket 120 and a corresponding opening 126 is provided in the housing 114. A brass tube 128 is positioned in the openings 124 and 126 which is used as a guide for an actuating member or trip rod 130. The bias rod 128 includes a slot 136 on diametrically opposite sides of the tube. Means are provided on the rod for limiting the motion of the rod in the tube. Such means is in the form of a pin 134 which extends into slots 136.

The coil 118 is formed from a strip of material such as described above and is formed into a coil by soldering one end of the coil to the brass tube 128 and spirally winding the coil around the brass tube 128 until the proper size is achieved. The strip of material is coated with 2 to 3 mil of insulation as described above. The last turn of the coil is soldered to the adjacent underturn. The coil is positioned within the housing 114 with a tab or lead 129 projecting outwardly through an opening 115 in the housing 114 for electrical connection to the coil 118.

A copper strip 132 having a center opening 131 is provided on the surface of the mounting bracket 120 and connected thereto by means of the rivets 122. The copper strip 132 is soldered to the brass tube 128 at the center opening 131 to provide an electric circuit to the brass tube 128. The circuit to the coil is then completed by connecting the strip 132 to the power source and the lead 129 on the outer edge of the coil to the current source to provide a current path through the coil 118.

The trip rod 130 is moved by the magnet assembly 112 on engagement of the assembly with a pin 134 that extends through the trip rod 130 into slots 136 provided in the brass tube 128. The magnet assembly 112 is shown as a single magnet having 6 poles which provided a holding force sufficient to hold the compression spring 138 in compression against the coil 118. When the coil 118 reaches its Curie temperature, the magnet assembly 112 will be released and the spring 138 will push the assembly 112 against the pin 134 to move the trip rod 130 into engagement with the trip lever 16 on the interrupter.

The high-fault current magnetic disc assembly 116 includes an armature disc 140 which is mounted on the trip rod 130 by means of a push nut 142 and is located in a spaced relation to the coil 118. Under high-fault current conditions, the magnetic field or flux density of the coil 118 will increase sufficiently to pull the armature disc 140 toward the housing 114. The pin 134 will move in slot 136 in the brass tube 128 without moving the magnet assembly 112.

Various other features and advantages of the invention are set forth in the following claims.

The embodiments of the invention in which an exclusive property or privilege is claimed, are defined as follows:

1. A sensor-tripper apparatus for tripping a trip lever of a circuit interrupter, said apparatus comprising a housing, a trip rod mounted in said housing and being movable into engagement with the trip lever for the circuit interrupter, a thermally responsive member having a predetermined Curie temperature and having means for connecting in series a primary circuit for sensing fault currents, a magnet assembly operatively connected to said trip rod and being positioned to be magnetically attracted to said member, means biasing said magnet assembly away from said member when the temperature of said member reaches its Curie temperature, whereby said magnet assembly will move said trip rod into engagement with the trip lever, a magnetic disc assembly mounted on said trip rod and being responsive to a high fault current in said primary circuit to move said trip rod independently of said magnet assembly into engagement with said trip lever.

2. The mechanism according to claim 1 where said member is the form of a metallic strip.

3. The mechanism according to claim 2 including means for stiffening said metallic strip.

4. The mechanism according to claim 1 wherein said member is in the form of a coil encircling said trip rod.

5. The mechanism according to claim 1 including a tube mounted in said housing, said trip rod being mounted for axial motion in said tube.

6. The mechanism according to claim 5 wherein said magnet assembly is mounted for axial movement on said tube.

7. The mechanism according to claim 1 or 2 including electrically conductive shunt means connected in parallel with said strip to vary the thermal response time of said strip.

8. The mechanism according to claim 7 wherein said electrically conductive shunt means comprises a shunt strip connected in parallel with said sensor strip.

9. The mechanism according to claim 7 wherein said shunt means includes a fuse housing having a pair of electrical contacts mounted in a spaced relation and a shunt cartridge removeably mounted in said fuse housing and being electrically connected to said contacts.

10. The mechanism according to claim 1 wherein said magnet assembly includes a cluster of magnets mounted in a circle whereby each magnet in the circle forms a separate flux path through said member.

11. The mechanism according to claim 1 wherein said magnetic disc assembly includes an insulation strip operatively connected to said trip rod and a metallic disc mounted on each end of said strip, said discs being positioned to respond to the total current through said primary circuit.

12. The mechanism according to claim 4 wherein said magnetic disc assembly includes a metallic disc mounted on said trip rod in a position to respond to an increase of flux density of said coil under high fault current conditions.

13. A sensor-tripper apparatus for tripping a primary circuit interrupter comprising a frame, a conductive tube mounted on said frame, a trip rod mounted for axial movement in said tube, a thermal sensing strip having a predetermined Curie temperature and being mounted on said frame and having means for connecting in series with a primary circuit, a magnet assembly mounted for axial movement on said tube into engagement with said sensing strip and being operatively connected to move said trip rod, spring means mounted between said magnet assembly and said sensing strip for biasing said magnet assembly away from said sensing strip when said strip reaches its Curie temperature, and a magnetic disc assembly mounted on said tube and being operatively connected to move said trip rod independently of said magnet assembly, said disc assembly including a metallic disc positioned adjacent said sensing strip to respond to an increase in flux density of said primary circuit in response to high fault current in said primary circuit.

14. The apparatus according to claim 13 including means for stiffening said thermal sensing strip.

15. The mechanism according to claim 13 wherein said strip is in the form of a coil encircling said tube.

16. The apparatus according to claim 13 including electrically conductive shunt means connected in parallel with said strip to vary the thermal response time of said strip.

17. The apparatus according to claim 16 wherein said electrically conductive shunt means comprises a shunt strip.

18. The apparatus according to claim 16 wherein said shunt means includes a fuse housing having a pair of electrically conductive contacts mounted in a spaced relation and a shunt cartridge removeably mounted in said fuse housing and being electrically connected to said contacts.

19. The apparatus according to claim 13 wherein said magnet assembly includes a cluster of magnets mounted in a circle whereby each magnet forms a separate flux path through said strip.

20. The apparatus according to claim 13 wherein said magnetic disc assembly includes an insulation strip operatively connected to said trip rod and a metallic disc mounted on each end of said strip said disc being positioned to respond to the total current through said primary circuit.

* * * * *